United States Patent [19]

Landa

[11] 4,329,070

[45] May 11, 1982

[54] METHOD OF AVOIDING COLLISIONS OF PROJECTILES IN A MICROBALLISTIC PRINTER

[75] Inventor: Benzion Landa, Edmonton, Canada

[73] Assignee: Savin Corporation, Valhalla, N.Y.

[21] Appl. No.: 205,003

[22] Filed: Nov. 7, 1980

[51] Int. Cl.[3] ..... B41J 3/02

[52] U.S. Cl. ..... 400/118; 400/121

[58] Field of Search ..... 400/16, 17, 118, 119, 400/121, 126; 101/114; 340/764, 783, 788; 346/141; 51/310, 319, 320, 424; 72/53

[56] References Cited

U.S. PATENT DOCUMENTS

| | | | |
|---|---|---|---|
| 2,837,076 | 6/1958 | Koci et al. | 124/51 R |
| 3,624,966 | 12/1971 | Palmer | 51/310 X |
| 4,046,131 | 9/1977 | Clark et al. | 124/51 R X |
| 4,094,294 | 6/1978 | Speer | 124/56 |
| 4,149,807 | 4/1979 | Avison et al. | 400/118 |
| 4,150,902 | 4/1979 | Brescia | 400/126 X |

*Primary Examiner*—Paul T. Sewell

*Attorney, Agent, or Firm*—Shenier & O'Connor

[57] ABSTRACT

The invention relates to a method of operating a microballistic printer in which successive projectiles are fired against a platen to print successive dots and the gun is moved along a path to form characters from the successive dots. In order to prevent collisions between successively fired projectiles, the gun is positioned away from a plane extending normal to and outside of the printing area of the platen. Successive movements of the gun are in a direction away from this plane toward the gun.

5 Claims, 2 Drawing Figures

METHOD OF AVOIDING COLLISIONS OF PROJECTILES IN A MICROBALLISTIC PRINTER

CROSS-REFERENCE TO RELATED APPLICATION

The microballistic printer to which the instant method applies is shown and described in my copending application, Ser. No. 39,372, filed May 15, 1979, abandoned.

BACKGROUND OF THE INVENTION

In my copending application, I have described a microballistic printer in which a plurality of projectiles such as balls are fired from a gun which is spaced from a platen. These projectiles are constantly recycled back to the gun after rebounding from the platen. The gun is controlled by a computer so that successive projectiles strike the platen along loci to form characters on paper or other sheet material bearing against the platen. A printing medium such as carbon paper, inked ribbon, or the like, is superimposed over the paper. When a projectile hits the printing medium, it will form a dot on the paper under it. The control is such that a pattern of dots is formed by successive projectiles to trace the desired character upon the paper. If desired, a manifold of alternate sheets of carbon paper and paper may be used so that carbon copies may be achieved. I have discovered that, when the gun is above a horizontal plane extending at right angles to the platen, when the printing pattern involves a motion from top to bottom—that is, downwardly toward the plane—a projectile being fired from the gun might collide with an antecedently fired projectile rebounding from the platen. At high-speed printing, there is only a short distance between balls, so that this danger becomes increased. Stated otherwise, if I form the characters with the gun above the plane and print with succeeding projectiles being fired toward the plane—that is, downwardly—a succeedingly fired projectile will cross the path of an antecedently fired projectile rebounding from the platen and thus incur the risk of collision. If, however, I form the characters by firing succeeding projectiles away from the plane, an antecedently fired projectile will rebound harmlessly from the platen and a subsequently fired projectile will not cross the path of a previously fired projectile rebounding from the platen. This avoids the danger of collision. Similarly, in respect of forming the characters, if the gun is left of a vertical plane normal to the platen and outside of the printing area, I must print from right to left. If I am printing from a gun positioned to the right of a vertical plane normal to the platen and outside of the printing area, I must print from left to right. This will avoid the danger of collision of a secondly fired projectile with the previously fired projectile rebounding from the platen.

FIELD OF THE INVENTION

My invention relates to a method of operating a microballistic printer in which a plurality of solid projectiles are propelled in free flight across a space from a gun to a platen, in which the flight is so controlled, not only to produce impacts on the medium in the pattern of the desired characters to be applied thereto, but also to avoid interference of successive projectiles moving at high speed from the gun with projectiles rebounding from the platen.

DESCRIPTION OF THE PRIOR ART

There is no relevant prior art of which I am aware.

SUMMARY OF THE INVENTION

My invention comprises firing successively projectiles from a gun to a platen spaced from the gun across the intervening distance to the platen which bears a printing assembly. In forming the characters, when the gun is above a horizontal plane extending normal to the platen, the projectiles are fired from bottom to top. If the gun should be below this horizontal plane, the characters are formed by printing so that the gun moves, in firing successive projectiles, from top to bottom. In forming the characters, when the gun is positioned to the left of a vertical plane extending normal to the platen, printing takes place from right to left. If, however, the gun is positioned to the right of said vertical plane, printing must take place by moving the gun, in successive firings, from left to right. Stated simply, the gun should move, in firing successive projectiles, in a direction toward the gun, away from the plane extending normal to the platen, if the danger of collision of projectiles is to be avoided. In carrying out my method, it is important to note that the gun should not be positioned in the horizontal plane normal to the platen. The gun should be positioned, preferably, above a plane normal to the platen or either to the right or to the left of a vertical plane normal to the platen.

OBJECTS OF THE INVENTION

One object of my invention is to provide a method of firing successive projectiles in a microballistic printer to avoid the collision of balls on the way to perform their printing function with balls rebounding from the printing medium after they have performed their printing function.

Another object of my invention is to prevent the collision of balls being shot from the gun of a microballistic printer with balls rebounding from the platen against which the balls were directed.

Other and further objects of my invention will appear from the following description.

DESCRIPTION OF THE PREFERRED EMBODIMENT

Figure 1:
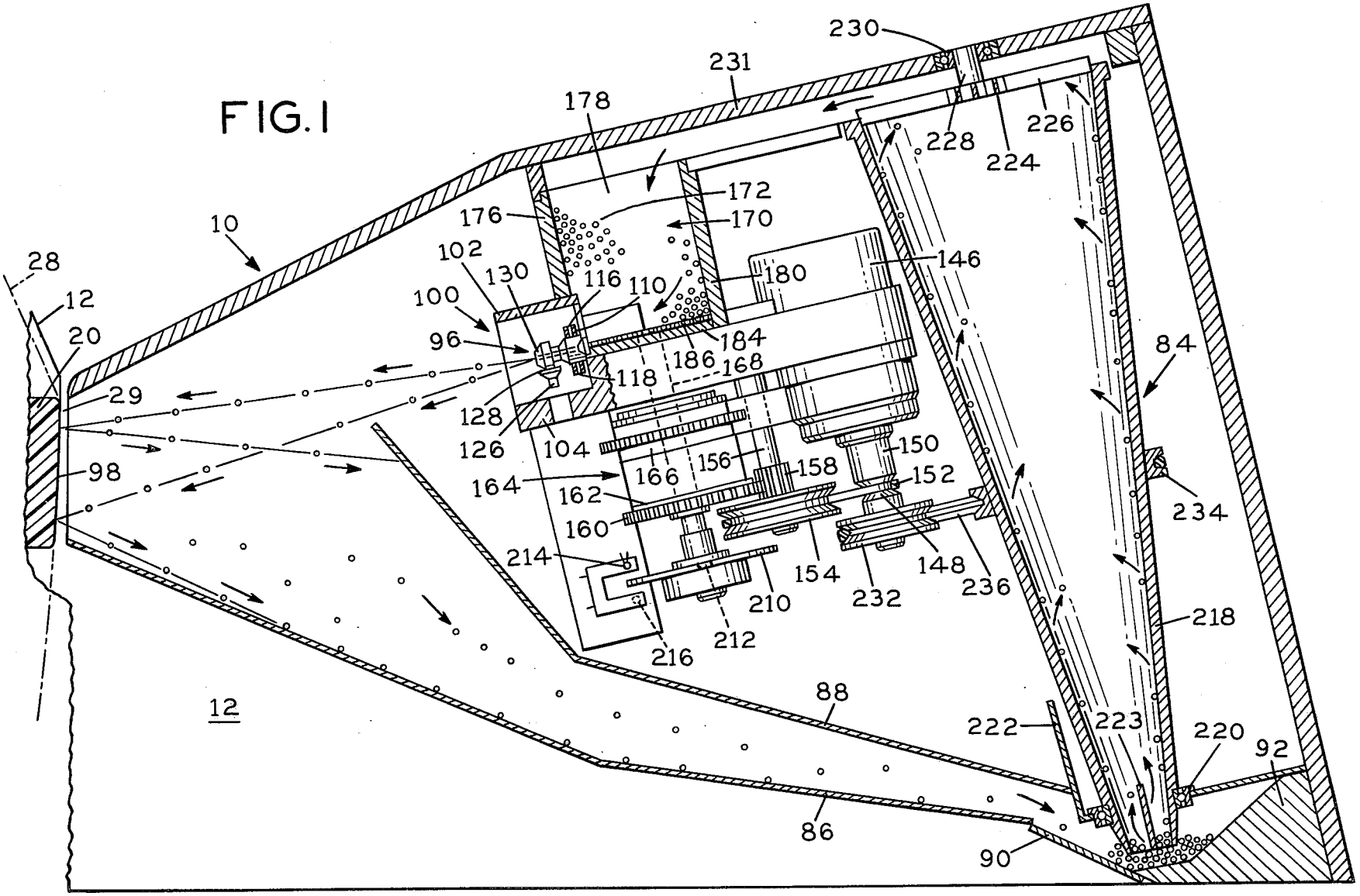
FIG. 1 is a sectional view of a microballistic printer, more particularly described in my copending application, Ser. No. 39,372.

More particularly, referring now to FIG. 1 of the drawings, my printer is generally indicated by the reference character 10 and includes a sidewall 12 shown with parts broken away. The platen 20 is secured between sidewall 12 and a complementary sidewall (not shown) and is formed of any suitable material. I have found that Plexiglas, which is the registered trademark of Rohm and Haas Co., of Philadelphia, Pa., for an acrylic resin, is an excellent material. The reference numeral 28 indicates the path of paper or the manifold of paper and carbon over the face of the Plexiglas surface 98. This surface is not flat, but formed on a very large radius so that the paper or manifold is in contact with the surface throughout the whole height of the platen 20 which is to be used in the printing operation. If desired, an inked ribbon (not shown) may be moved at right angles to the path of the paper through the space 29 between the platen and a cover plate 231 of the gun assembly of my printer. The bottom of the space is defined by a lower guide 86 which returns projectiles fired from the gun for recycling, as will be described more fully hereinafter. The gun assembly, indicated generally by the reference character 96, is disposed in a housing indicated generally by the reference character 100. The housing has a top 102 and a bottom 104. A gimbal ring 110 is supported by a pair of axially aligned pivot pins 116 and 118 which define the axis around which the abscissas of the characters are formed. A pair of pivot pins (not shown), disposed at right angles to the pivot pins 116 and 118, support the gun for movement around the X axis about which the gun is rotated to form the ordinates of the characters. The platen 20 is hard enough to act as an anvil, yet sufficiently soft so the impact of the balls will not chip or damage the surface. An actuating drive rod 126, controlled by any appropriate means and described in my copending application, controls the movement of a cam 128 which acts on a coacting cam surface 130 to move the gun upwardly and downwardly. A similar control rod and cam surface (not shown) are adapted to move the gun in a horizontal direction acting on the cam surface 130 to form the abscissas of the characters, as described in my copending application. A motor 146 is adapted to be energized to drive an integral sheave 148 formed in the shaft 150 of the motor. A belt 152 is connected to a sheave 154 carried by an idler shaft 156 which is supported by the machine frame. This shaft carries a pinion 158 which meshes with a gear 160 secured to an input element 162 of a slip clutch indicated generally by the reference character 164. This clutch 164 may be of any appropriate type known to the art and includes an output element 166 carried by a shaft 168 for rotation therewith. The arrangement is such—as is known in the art—that, as long as the output member 166 is restrained against rotary movement, the input member 162 will rotate relative thereto. When, however, the member 166 is free to rotate, clutch 164 engages elements 162 and 166 so that shaft 168 will be driven from the motor 146 through belt 152, sheave 154, pinion 158, gear 160, and clutch 164.

My microballistic printer includes a ball storage bin indicated generally by the reference character 170. The bin is formed of walls 176, 178, 180, a fourth wall (not shown), and a bottom 184 adapted to store a quantity of solid balls 172. I form these balls of any appropriate hard material, such as, for example, tungsten carbide. Shaft 168 carries a projectile or ball feeding element in the form of a saw-tooth blade 186 having a plurality of teeth. As the blade 186 rotates, the balls between the teeth are fed to the gun for projection by it. The balls 172, after being shot from the gun, are returned to the bin 170 after rebounding from the platen 20. They are collected by gravity in a sump formed by a bottom plate 90 and a bottom casting 92, whence they are elevated, as will be described hereinafter, for recycling to the bin. As the shaft 168 rotates, the teeth of the saw blade will feed the balls 172 to the gun, as described in my copending application. The arrangement of my printer is such that clutch element 166 is released for a period of time sufficient to cause the feeding blade 186 to move a predetermined number of balls required to carry out a program or subprogram in the course of the formation of a character. The shaft 168 carries a counter disc 210 for rotation therewith. The counter disc is provided with holes 212 corresponding to the number of teeth on the blade 186. A portion of the disc 210 is adapted to move across a light path between an incandescent lamp 214 and a photocell 216 to cause the photocell to render a signal each time a ball is fed by the blade 186 to the gun. The digital signal corresponding to the number of balls which are fed during the period of forming a program or subprogram is fed back to tell the computer (not shown) that the program has been completed.

My microballistic printer includes a "cyclone" ball return system in which the balls collected in the sump described above are elevated by an inverted conical hollow member 218 which is driven by a belt 236 from a pulley 232 carried by the motor shaft 150. The inverted cone is mounted for rotation by lower bearing 220 and upper bearing 230. A spider formed by spokes 224 and 226 supports a shaft 228 for rotation in the upper bearing 230. A sheave 234 carried by the conical member transmits rotary motion to the "cyclone" elevator. A vertical plate 223 at the lower entrance of the elevator 218 assists the balls to enter the bottom of the elevator. The balls move upwardly and are returned to the bin 170, as can readily be seen by reference to FIG. 1. The balls 172 have a diameter of 0.8 mm. and produce a spot size of about 0.33 mm. Firing of the balls and their orientation is controlled by a computer (not shown) which responds to the characters commanded to be made—as is well known in the art. I contemplate firing about two thousand balls per second. The interval between firings is such as to permit the gun to be addressed between firings to form the desired character.

Figure 2:
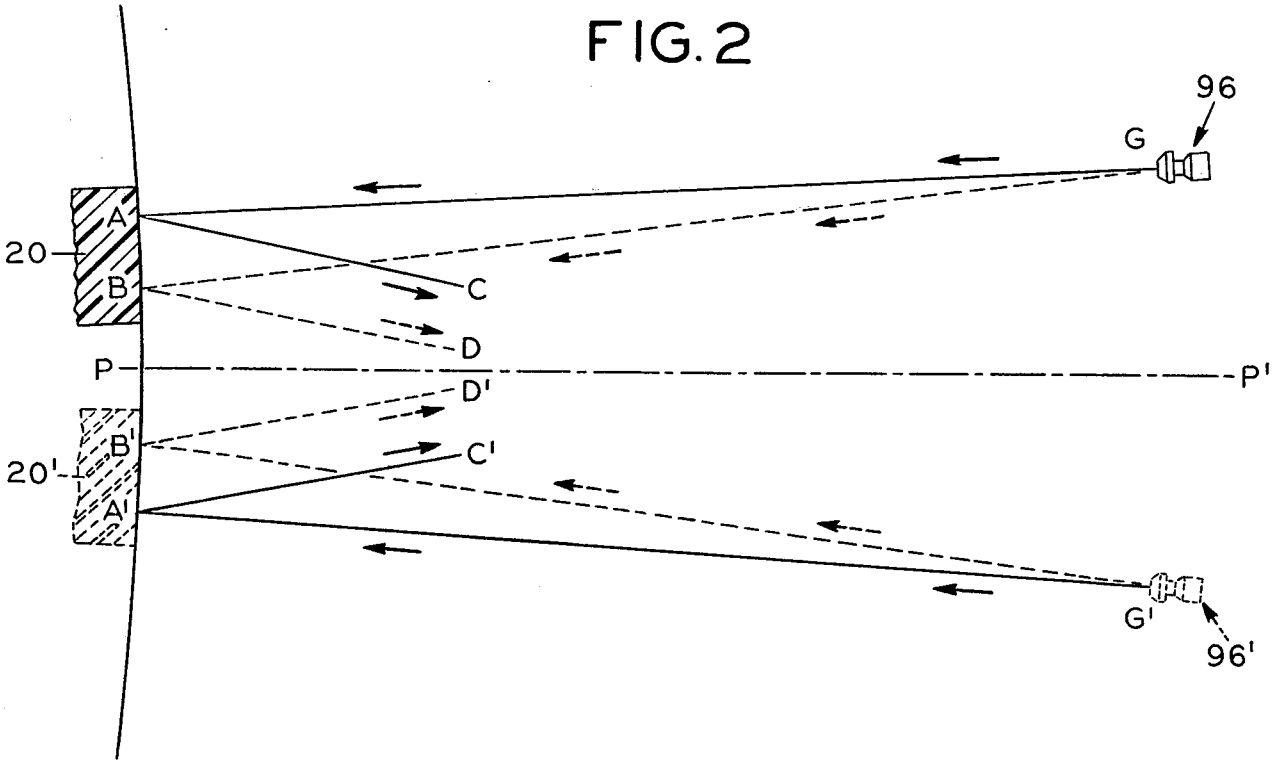
FIG. 2 is a diagrammatic view showing successive paths of two projectiles positioned on opposite sides of a plane normal to the platen. The plane may be considered to be either a horizontal or vertical plane.

Referring now to FIG. 2, the gun at G, indicated by reference numeral 96, is fired to propel a projectile along the path G—A. Since the distance the projectiles travel is short and the velocity high, the trajectories are substantially straight lines. When this firing occurs, since the angle of reflection is roughly equal to the angle of incidence, the projectile will rebound along the path A—C. It will be seen by reference to FIG. 2 that, if a second projectile is fired along path G—B, there is danger that the projectile moving along this path may collide with the antecedently fired projectile rebounding along the path A—C. When a projectile is fired first along the path G—B, it will rebound along the path B—D. In this circumstance, it will be seen by reference to FIG. 2 that, if a projectile is fired first along the path G—B, there is no danger of a subsequently fired projectile moving along the path G—A colliding with the projectile rebounding along the path B—D.

A plane indicated by the letters P—P′ extends at right angles or normal to the plane of the platen 20. If the plane P—P′ is considered to be horizontal, the gun 96 at position G will be above this plane and above the platen on which the characters are formed. Stated otherwise, the gun must be positioned above a plane extending normal to or at right angles to the platen slightly above the highest of the ordinates of the characters to be formed. Obviously, if the gun is directly in line with the platen, the projectile will rebound along the same path it took to reach the platen and a collision with a succeeding projectile will be inevitable. Accordingly, the gun must be placed to trace downwardly extending trajectories when addressing the uppermost ordinate of a character as well as the lowermost ordinate of the same.

The gun could be placed below the plane P—P′ and the same principle would apply. That is, if a projectile is fired along the path G′—A′ so it will rebound along the path A′—C′, a subsequently fired projectile moving along the path G′—B′ is in danger of colliding with a projectile rebounding along the path A′—C′. It will be seen, therefore, that if a projectile is first fired along the path G′—B′, its rebounding path will be B′—D′, so that if a projectile is subsequently fired along the path G′—A′, it will not interfere with the projectile rebounding along the path B′—D′. If the plane P—P′ is vertical, the gun at position G must be placed to the right of the plane and to the right of a parallel plane extending from the right boundary of the widest character being formed. Similarly, if the gun is to the left of the plane P—P′, it must be positioned to the left of a plane parallel to the plane P—P′ extending from the leftmost portion of a character being formed.

By reference to FIG. 2, it will be seen that the same result will be obtained if the successive projectiles are fired, in the case of the gun at position G, from left to right and, in the case of the gun at position G′, from right to left. The avoidance of collision in my method depends on positioning the gun, if above the platen, by firing successive projectiles from the bottom to the top—that is, in successive directions away from a plane normal to the platen above which the gun is positioned. If the gun is positioned below the platen, the gun must be moved from top to bottom—that is, in a direction away from the plane normal to the platen. Similarly, if the gun is positioned to the right of the platen, the gun must be moved from left to right in successive firings—that is, away from the vertical plane P—P′; and if the gun is positioned to the left of the platen, it must be moved from right to left—that is, away from the vertical plane P—P′.

In carrying out my method, I first determine whether I want to position the gun above or below the platen or to the right or left of the platen. Having determined this, I can fire the gun so that successive projectiles are fired at successive positions, each succeeding position making a smaller angle with the plane normal to the platen. Stated otherwise, the gun is fired so that each succeeding position of the gun will make a greater angle with the plane of the platen, and always provided that such angle is less than ninety degrees.

It will be seen that I have accomplished the objects of my invention. I have provided a method of firing successive projectiles in a microballistic printer to avoid collision of projectiles on the way to perform their printing function with projectiles rebounding from the printing medium. My invention is such as to prevent the collision of balls being shot from the gun of a microballistic printer with balls rebounding from the platen, irrespective of whether the balls are forming an ordinate portion or an abscissa portion of a character being printed.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A method of operating a microballistic printer having a gun for firing projectiles in succession across a space to a platen having a printing area to form characters on a medium placed against the platen, including the steps of positioning the gun spaced from a plane normal to and outside of a boundary of the printing area of the platen and moving the gun to form characters in successive steps, each moving step being in a direction toward the gun, whereby every subsequently fired projectile prints in a direction away from a previously fired projectile rebounding from the platen, thereby avoiding collision of a subsequently fired projectile with a previously fired projectile rebounding from the platen.

2. A method of operating a microballistic printer having a gun for firing projectiles in succession across a space to a platen having a printing area to form characters on a medium placed against the platen, including the steps of positioning the gun spaced above a horizontal plane normal to and above the boundary of said printing area and moving the gun to form characters in successive steps, each moving step in a vertical direction being from bottom to top, whereby every subsequently fired projectile prints in a direction away from a previously fired projectile rebounding from the platen.

3. A method of operating a microballistic printer having a gun for firing projectiles in succession across a space to a platen having a printing area to form characters on a medium placed against the platen, including the steps of positioning the gun spaced below a horizontal plane normal to and below the boundary of said printing area and moving the gun to form characters in successive steps, each moving step in a vertical direction being from top to bottom, whereby every subsequently fired projectile prints in a direction away from a previously fired projectile rebounding from the platen.

4. A method of operating a microballistic printer having a gun for firing projectiles in succession across a space to a platen having a printing area to form characters on a medium placed against the platen, including the steps of positioning the gun spaced to the left of a vertical plane normal to and to the left of said printing area and moving the gun to form characters in successive steps, each moving step in a horizontal direction being from right to left, whereby every subsequently fired projectile prints in a direction away from a previously fired projectile rebounding from the platen.

5. A method of operating a microballistic printer having a gun for firing projectiles in succession across a space to a platen having a printing area to form characters on a medium placed against the platen, including the steps of positioning the gun spaced to the right of a vertical plane normal to and to the right of said printing area and moving the gun to form characters in successive steps, each moving step in a horizontal direction being from left to right, whereby every subsequently fired projectile prints in a direction away from a previously fired projectile rebounding from the platen.

* * * * *